US006128978A

United States Patent [19]

Richey

[11] Patent Number: 6,128,978

[45] Date of Patent: Oct. 10, 2000

[54] COMBINATION NAIL SET

[76] Inventor: Derek James Richey, 304 River Bluffs Dr., New Bern, N.C. 28560

[21] Appl. No.: 09/253,488

[22] Filed: Feb. 19, 1999

[51] Int. Cl.[7] ..... B25C 3/00

[52] U.S. Cl. ..... 81/44; 81/439

[58] Field of Search ..... 81/44, 439, 177.2

[56] References Cited

U.S. PATENT DOCUMENTS

| | | | |
|---|---|---|---|
| 356,666 | 1/1887 | Shattuck | 81/44 |
| 722,559 | 3/1903 | Bond | 81/44 |
| 1,127,838 | 2/1915 | Willers | 81/44 |
| 1,702,607 | 2/1929 | Jensen | 81/44 |
| 1,838,462 | 12/1931 | Stanford | 81/44 |
| 1,980,583 | 11/1934 | Gurley | 81/44 |
| 2,438,633 | 3/1948 | Condor | 81/177.2 |
| 2,917,954 | 12/1959 | Capelle | 81/439 |
| 3,034,550 | 5/1962 | Dahl | 81/439 |
| 3,342,228 | 9/1967 | Reid | 81/44 |
| 4,954,025 | 9/1990 | Crawford et al. | 7/158 |
| 4,960,235 | 10/1990 | Gregory | 227/147 |
| 5,222,848 | 6/1993 | Kuang-Wu | 7/158 |

*Primary Examiner*—David A. Scherbel
*Assistant Examiner*—David B Thomas
*Attorney, Agent, or Firm*—Mills Law Firm PLLC

[57] ABSTRACT

A combination nail set includes an outer cylindrical impact sleeve within which a dual tipped setting tool is slidably supported for reciprocation between detented operative positions to expose selectively a setting tip for recessing nail heads of varying sizes into a workpiece.

8 Claims, 2 Drawing Sheets

COMBINATION NAIL SET

FIELD OF THE INVENTION

The present invention relates to the field of woodworking and, in particular, nail sets for recessing nails heads below the surfaces of workpieces for a variety of nail sizes.

BACKGROUND OF THE INVENTION

Nail sets are commonly used in woodworking for recessing the head of a nail below the surface of a workpiece to eliminate exposure thereof and allow the resulting countersunk hole to be filled with appropriate material preparatory to finishing the workpiece. While a wide variety of nail sizes are employed in such applications, generally such nails sets are available in three sizes: fine, medium and large. Such nail sets are typically formed of impact resistant material, such as hardened tool steel, and have a body portion which is gripped by the user, a head portion which is impacted by the setting tool, a conical tip which terminates in a point configuration that is adapted securely engage the nail head while resisting drifting of the tool from head between successive impacts thereby preventing marring or disfiguration of the surrounding material. The nail set body may be textured to facilitate usage and enhance the appearance thereof. Such nails sets are widely accepted and satisfactorily perform the desired controlled countersinking of the nail head.

Within ordinary woodworking tasks, finish nails of vary sizes may be utilized. Accordingly, for each discrete nail head, the installer must select the appropriate nail set requiring the location and selection thereof for each nail size. In addition to the need for a separate nail set for each size classification, the associated changeover time can encourage the installer to continue to use the current tool for the wrong size nail, often with unacceptable injury to the workpiece. Such consequences can be mitigated by providing the nail sets in kit form for easy identification and selection. Nonetheless, a separate nail set must be used for a given task. Few efforts have been made to overcome such limitations. In one approach, an elongated strap member has been provided that carries a plurality of set points. By manipulating the strap member, the desired set point is compressively engaged with the exposed nail head and impacted by the hammer. Such a tool is a marked departure from the feel and techniques with which installers are experienced. Further, the cantilevered arrangement makes correct axial alignment difficult resulting in the set point sliding or drifting off the nail head and damaging the workpiece.

In view of the foregoing, there is a need for providing a cost effective and time effective nail set that can be used to countersinking conventional finish nails in an operative format with which the installers and trades feel comfortable.

SUMMARY OF THE INVENTION

The present invention overcomes the above-noted deficiencies of conventional nail sets in a user-friendly format for the installer. The combination nail set comprises two basic components; an outer impact sleeve for receiving the impact forces and transferring the same directly axially to a dual pointed setting tool that can be selectively position to maintain separate set points in operative locked positions. More particularly, the combination nail set comprises an elongated cylindrical sleeve member having a cylindrical passage. Therein, a nail set member having a cylindrical center body portion is slidably disposed within said cylindrical passage in said sleeve member. Friction means are operative between the sleeve member and the center body portion of said nail set member for resisting sliding movement between said nail set member and said sleeve member. A first end portion on one end of said nail set member is formed integrally with the center cylindrical body portion and terminates with a first tip portion adapted to engage a nail head of one size. A second end portion is formed integrally on the other end of the nail set member and terminates with a second tip portion adapted to engage a nail head of another size. Diametrically opposed pin means extend radially outwardly of the center body portion. A pair of diametrically opposed, axially extending slots formed in the sleeve member terminates at the ends thereof with circumferentially extending recesses. The pin means register with the slots and are disposed for sliding movement therewithin and rotatable into the recesses. The axial extent of the slots operatively exposes the first end portion when the pin means is positioned in one of said recesses while locating the second end within the sleeve member in a first nail set position, and operatively exposes the second end portion when the pin means is positioned in the other of the recesses while locating the second end within the sleeve member in a second nail set position. Impacting the sleeve member with the nail set member in either of said nail set positions will transfer the impact forces through the pin means axially to the nail set member for recessing the nail head below the surface of the workpiece. The overall length and cross-section of the combination nail set is comparable to existing tools. Further, the arrangement for provides for controlled accurately axially directed forces on the nail head to be recessed. Moreover, the nail set may be definitively labeled to allow the user to quickly and accurately select the appropriate set point for the task at hand.

Accordingly, it is an object of the present invention to provide a nail set for recessing nail heads below the surface of a workpiece that can accommodate varying nail sizes in a conventional format and size.

Another object of the present invention is to provide a nail set wherein the user can select in a single tool the appropriate set point for recessing a nail head.

A further object of the present invention is to provide a multi-purpose nail set having user selected set points for properly recessing a nail head in a workpiece.

Yet another object of the present invention is to provide a nail set for recessing a variety of nail head sizes in a single tool wherein the user may selectively expose the desired set point and accurately and directly axially impact the nail head for countersinking.

BRIEF DESCRIPTION OF THE DRAWINGS

The above and other objects and advantages of the present invention will become apparent to those skilled in the art upon reading the following detailed description of the preferred embodiments taken in conjunction with the accompanying drawings in which.

DETAILED DESCRIPTION OF THE PREFERRED EMBODIMENT

Figure 1:
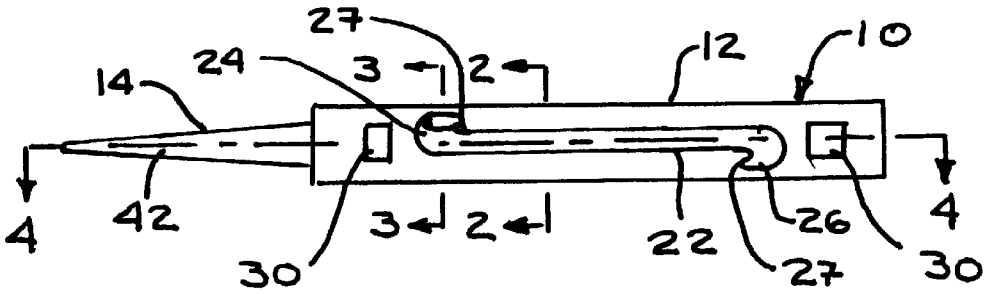
FIG. 1 is a side elevational view of a combination nail set in accordance with the invention showing one operative setting position.

Referring to the drawings for the purposes of illustrating a preferred embodiment of the present invention and not for limiting same, FIG. 1 shows a combination nail set 10 for use in recessing nail heads of varying sizes beneath the surface of a workpiece. As hereinafter described in greater detail, the nail set 10 selectively provides two nail set tips that can be operatively exposed to engage the nail head. Upon impacting the other end of the nail set with a suitable tool, such as a hammer, drive the head below the workpiece surface for subsequent filling of the resulting recess with wood putty or like filler. Typically, conventional nail sets are provided in three sizes: fine, medium and large. This range has been found to handle the countersinking tasks for most woodworking applications. Herein, the nail set is provided with two adjacent tip sizes, i.e. fine and medium, or medium and large and accordingly provide, in a single unit, the sizes predominantly used in a particular application. However, it will be appreciated that other combinations may be used.

Figure 6:
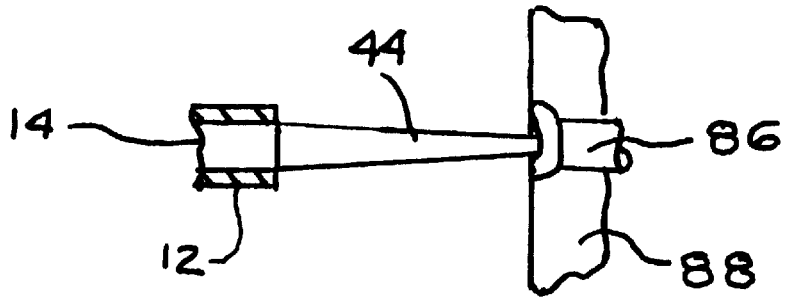
FIG. 6 is an enlarged elevational view illustrating the combination nail set in one operative position.
Figure 7:
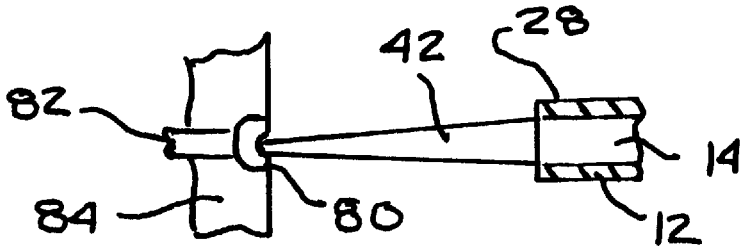
FIG. 7 is an enlarged elevational view illustrating the combination nail set in the other operative position.

The combination nail set 10 generally comprises an outer impact sleeve 12 and an inner dual point setting tool 14, which may be selectively positioned as shown in FIGS. 6 and 7 to expose one of two set tips for countersinking nail heads of varying sizes.

Figure 4:
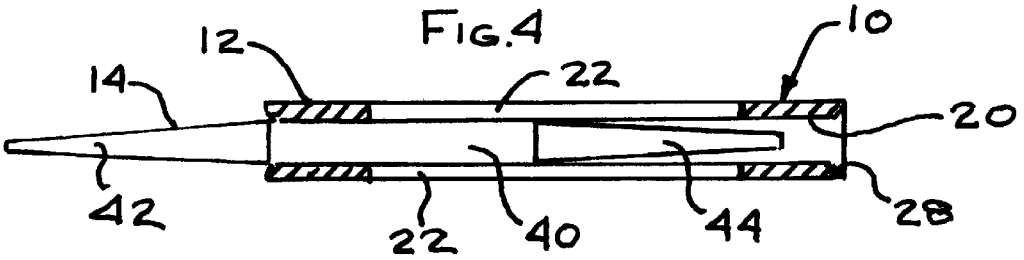
FIG. 4 is a cross sectional view taken along line 4—4 in FIG. 1.

The impact sleeve 12 is an elongated, hollow circular cylinder having an inner coaxial cylindrical passage or bore 20 (FIG. 4). The sleeve is preferably formed of an impact resistant material such as hardened tool steel. The size of the sleeve 12 is preferably the same as conventional nail set bodies around 2 to 3 inches in length with a diameter of about ⅜ to ½ inch and a central bore 20 of ¼ to ⅜ inch. The wall thickness of the sleeve 12 is preferably at least ⅛ inch or greater. The foregoing may obviously be varied in accordance with users preferences and applications.

Figure 5:
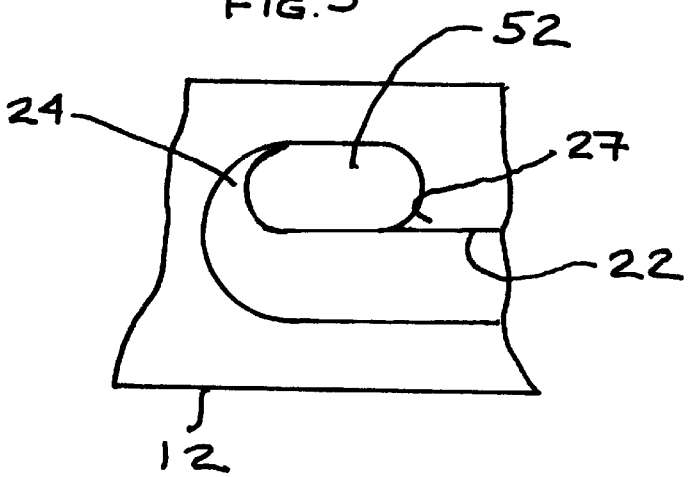
FIG. 5 is an enlarged fragmentary view illustrating the detent locking in a nail set position.

Referring additionally to FIG. 4, the impact sleeve 12 is provided with a pair of diametrically opposed, axially extending slots 22. The slots 22 are centrally disposed along the length thereof. A pair of oppositely circumferentially extending cross-slots 24 and 26 are formed at opposite of the slots 22. As described in greater detail below, the slots 22, 24 and 26 are adapted to receive a cross pin on the nail set 14 and permit the latter to be slidably shifted between operative nail set positions. Referring to FIG. 5, the cross-slots 24, 26 are reversely axially recessed to provide a lip or projecting detent 27 at the juncture between the slot 22 and adjacent cross-slot to establish a locked condition for the nail set in the operative positions. The length of the slot is sufficient to expose the desired tip length of the nail set in either position. Generally, a slot length of about ¾ to 1½ inch will provide sufficient travel for such purpose. To reduce splaying or mushrooming of the ends of the impact sleeve 12, the inner ends thereof are provided with an internal chamfer 28.

The outer surface of the impact sleeve 12 may be provided with surface texturing through knurling, rubber coating or the like to facilitate handling and operating of the combination nail set. Additionally, the impact sleeve 12 may be provided with suitable indicia 30 at the ends thereof for designating or labeling the operative tip size at such position.

Figure 8:
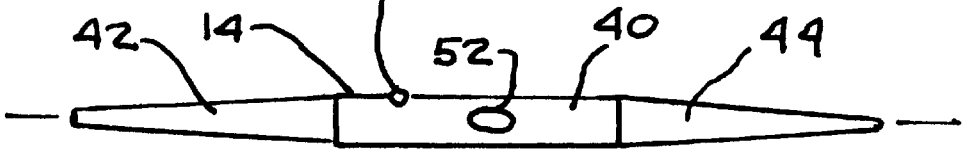
FIG. 8 is a top view of the setting tool.
Figure 9:
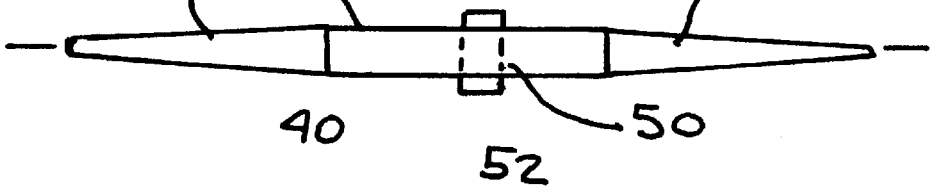
FIG. 9 is a side view of the setting tool.

Referring to FIGS. 4, 8 and 9, the setting tool 14 is slidably disposed within the impact sleeve 12 and includes a cylindrical center body 40 having a sliding, clearance fit with the center bore 20, a first frusto-conical tip 42 at one end and a second frusto-conical tip 44 at the other end. The tips 42 and 44 have end configurations conventionally associated with nail heads of different size classifications. The length of the center body 40 and a tip is around the length of the impact sleeve 12 whereby one or the other of the nail tips is exposed for operation. At such operative position, the other tip is located within the impact sleeve 12. The conic angle for the tips should be in a conventional range. The setting tool 14 is formed of an impact resistant material such as hardened tool steel.

Figure 3:
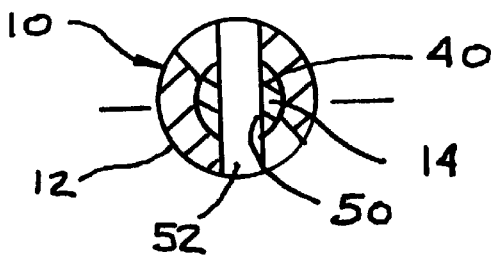
FIG. 3 is an enlarged cross sectional view taken along line 3—3 in FIG. 1 illustrating a locked nail set position.

Referring to FIG. 3, a cross-hole 50 is formed diametrically through the center body 40 at the middle portion thereof. A guide pin 52 is fixedly retained in the hole 50 by compression fit, brazing or the like. The ends of the guide pin 52 extend radially outwardly through the slots and terminate at or outwardly of the outer surface of the impact sleeve 12. If the guide pin 52 is used as the guiding and shifting member for moving between positions, the outward projection thereof should be sufficient for convenient manual engagement. The guide pin 52 may be in various cross sectional configurations, with circular of oval shapes being preferred to facilitate manufacture thereof. The relationship with the slots should provide sufficient clearance for guided movement therealong without undue rotational movement within the confines thereof. The guide pin 52 is formed of an impact resistant material such as hardened tool steel. The guide pin or similar configurations may be formed integrally with the setting tool.

Figure 2:
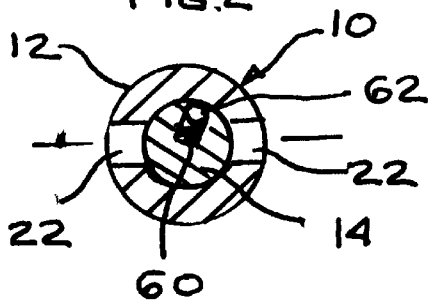
FIG. 2 is an enlarged cross sectional view taken along line 2—2 in FIG. 1 illustrating the slide resisting mechanism.

In order to prevent sliding or rotation of the setting tool 14 relative to the impact sleeve 12 is provided with a biased detent. As shown in FIG. 2, a blind cross-hole is formed radially in the center body 40. A compression spring 60 is retained in the cross-hole and outwardly biases a ball 62 into compressive engagement with the inner cylindrical surface defining the center bore 20. In combination with the lip 27, the detent serves to maintain the locked condition for nail setting as well as limiting unrestrained travel within the main axial slots.

In operation, as shown in FIGS. 6 and 7, the combination nail set 10 of the present invention may be disposed in two operative positions. To establish the first position (FIG. 7), the desired set tip 42 is fully extended to the end of the slots 22 and circumferentially rotated into the cross-slot 26 through shifting of the guide pin 52 and/or manual movement of the exposed tip. In the locked condition, the pin 52 is restrained against unlocking circumferential rotation by cooperation with the detent lip 27. Upon impacting the end of the impact sleeve 12 with a suitable tool such as a hammer, the resultant force "F" is transferred to the guide pin 52 and resultantly along the axis of the tip 42 against the exposed head 80 of a nail 82 in a workpiece 84. In the other position as shown in FIG. 6, the guide pin 52 is suitably shifted to locate the guide pin in the recess 24 thereby exposing the other setting tip 44 for recessing the engaged nail head 86 below the surface of the workpiece 88.

While the above features and advantages of the present invention have been described with reference to a preferred embodiment of the combination nail set, other modification thereof will become apparent to those skilled in the art. According, the present invention embraces all such modifications and variations and are to be solely defined by the appended claims.

What is claimed:

1. A combination nail set for recessing a nail head below the surface of a workpiece, comprising:

an elongated cylindrical sleeve member having a cylindrical passage therein;

a nail set member having a cylindrical center body portion complementary to and slidably disposed for sliding movement within said cylindrical passage;

friction means operative between said sleeve member and said center body portion of said nail set member for resisting said sliding movement;

a first end portion on one end of said nail set member integral with said center cylindrical body portion and terminating with a first tip portion adapted to engage a nail head of one size;

a second end portion on the other end of said nail set member integral with said center cylindrical body portion and terminating with a second tip portion adapted to engage a nail head of another size;

guide means formed on and extending radially outwardly of said center body portion;

a pair of diametrically opposed, axially extending slots formed in said sleeve member and terminating at the ends thereof with circumferentially extending recesses, said guide means registering with said slots and disposed for sliding movement therewithin and rotatable into said recesses, the axial extent of said slots operatively exposing said first end portion from one end of said sleeve member when said guide means is positioned in one of said recesses while locating said second end within said sleeve member in a first nail set position, and operatively exposing said second end portion from the other end of said sleeve member when said guide means is positioned in the other of said recesses while locating said second end within said sleeve member in a second nail set position, whereby impacting said sleeve member with said nail set member in either of said nail set positions will transfer the impact forces through said guide means axially to said nail set member for recessing the nail head below the surface of the workpiece.

2. The combination nail set as recited in claim 1 wherein said slots and said recesses are configured to present a circumferential stop engagable by said guide means in said nail set positions and resisting circumferential rotation of said nail set member into registry with said slots.

3. A combination nail set for recessing a nail head below the surface of a workpiece, comprising: a hollow cylindrical sleeve member; a nail set member slidably disposed within said sleeve member; a first end portion on one end of said nail set member having a first tip portion adapted to engage a nail head of one size; a second end portion on the other end of said nail set member having a second tip portion adapted to engage a nail head of another size; a cross member carried by said nail set member and projecting outwardly thereof; slot means formed axially in said sleeve member, said slot means having a first end located adjacent one end of said sleeve member in a first position and a second end located adjacent the other end of said sleeve member in a second position, said slot means slidably receiving said cross member and establishing load transferring relationships between said cross member and said sleeve member in said first position and said second position, the arrangement being such that said first tip portion is exposed at said one end of said sleeve member in said first position and said second tip portion is exposed at said other end of said sleeve member in said second position, whereby impacting said sleeve member will transfer the impact forces through said cross member axially to said nail set member for recessing the nail head below the surface of the workpiece.

4. The combination nail set as recited in claim 3 wherein detent means are operative between said sleeve member and said nail set member resisting sliding movement therebetween.

5. The combination nail set as recited in claim 4 wherein locking means are operative between said sleeve member and said cross member for maintaining said nail set member in a locked condition at said first position and said second position.

6. The combination nail set as recited in claim 4 wherein indicia are provided at the ends of said sleeve member for identifying the tip portion associated therewith.

7. The combination nail set as recited in claim 4 wherein said detent means comprises a radial hole formed in said sleeve member and a detent member located in said hole and biased outwardly into engagement with said sleeve member.

8. The combination nail set as recited in claim 5 wherein said locking means prevents relative rotation between said sleeve member and said nail set member in the locked conditions.

* * * * *